US006127611A

United States Patent [19]

VansEvers

[11] Patent Number: 6,127,611

[45] Date of Patent: Oct. 3, 2000

[54] APPARATUS AND METHOD OF OPTIMIZING THE TONAL BALANCE OF INSTRUMENTS WITH END-PINS

[76] Inventor: Claude M VansEvers, 5815 6th St., Tampa, Fla. 33611

[21] Appl. No.: 09/427,252

[22] Filed: Oct. 26, 1999

[51] Int. Cl.[7] ..... G10D 3/02

[52] U.S. Cl. ..... 84/294; 84/410; 84/453

[58] Field of Search ..... 84/294, 410, 453

[56] References Cited

U.S. PATENT DOCUMENTS

| | | | |
|---|---|---|---|
| 4,018,129 | 4/1977 | Hollander | 84/294 |
| 5,920,020 | 7/1999 | Korupp . | |
| 5,929,353 | 7/1999 | Taninbaum . | |

OTHER PUBLICATIONS

Fletcher, Neville H., and Rossing, Thomas D; The Physics of Musical Instruments, Second Edition; 1998; Springer; Chapter 19.

Bucur, Voichita, Acoustics of Wood; 1995; CRC Press; Chapter 6, p. 119 & 120; Chapter 7, table 7.2.

*Primary Examiner*—Paul Ip

*Assistant Examiner*—Shih-yung Hsieh

[57] ABSTRACT

A multi-mode adjustable-tone and tone-adjusting end-pin holder and methods for enhancing and optimizing the tonal balance and sonic quality of end-pin equipped instruments are disclosed. The sympathetically resonating holder is comprised of both wide band and narrow band resonators, fixed and variable, and can be made from wood species not normally associated with orchestral instruments. An acoustic instrument is mechanically coupled via its end-pin to a base with selected resonant characteristics upon which a plurality of resonators are located. These resonators are adjusted and/or selected to make the musical instrument's tone more aesthetically pleasing to the musician. The resonators are attached to the base via means which allow the resonant properties of the resonators to be varied as musical demands vary. The holder is provided with compliant feet that anchor the instrument and decouple it from stage floors, as well as a provision for optional bypassing of the decoupling action of the feet.

17 Claims, 5 Drawing Sheets

APPARATUS AND METHOD OF OPTIMIZING THE TONAL BALANCE OF INSTRUMENTS WITH END-PINS

BACKGROUND OF THE INVENTION

1. Field of the Invention

This invention relates to a resonant end-pin holder for musical instruments with end-pins. More particularly, this invention relates to a multi-mode adjustable-tonality end-pin holder and methods for enhancing and optimizing the tonal balance and sonic quality of end-pin equipped instruments.

2. Description of the Related Art

While hundreds of years have gone into the evolution of many instruments, a large degree of variability of tone is still prevalent within types of instruments. Some instruments will have a response that accentuates upper harmonics while attenuating its lower octaves, while others will have a response exactly opposite in those same frequencies. Most instruments will have an uneven response where problems cover a smaller range of frequencies. The smooth tonal balance found in the best instruments is created by an even distribution of resonances, which has yet to be reliably duplicated in modern instruments, even though great strides have been made in the science of materials, and, for instance, the science of violin building. The best instruments have an evenness of tone, and high price, that separates them from lesser instruments and most musicians. And while luthiers as a whole have many traditional and even some newer techniques for building the new and modifying the old, there is still a great disparity between the best and worst in terms of tonality.

To a musician, an instrument's tone is its most valuable feature, and great tone is seemingly at times a happenstance and serendipitous result of an assemblage of vibrating tubes, plates, membranes, strings and air chambers. These vibrations that result from the playing of an instrument travel freely throughout the instrument and thus naturally excite all of its parts, and these parts contribute resonate energy which is conducted through the body of the instrument to the radiating members. Every part of the instrument thus contributes to its overall sound, even when that part is not considered a sound radiator. In U.S. Pat. No. 5,929,353 a solid resonator ring is shown which is to be affixed to the mouthpiece of a saxophone or other reed instrument so that it is intimately in contact with the body of the instrument. This resonator ring is not a primary vibrator as are the reed and the air column of the instrument, and so must act like a feedback device which influences the instrument's tonality by adding its energy of resonance to the resonant energy of the vibrating reed and air column.

In the same way, an instrument's end-pin is in intimate contact with the body of the instrument and as such will contribute its resonant energy to the instrument's sound. This is one reason for the current experimentation with different and sometimes exotic materials used for end-pin construction. Also in the same way, an end-pin is usually in intimate contact with a stage floor, and an end-pin cannot be a one way street for vibrations. The resonant properties of the particles which make up the stage floor material upon which the end-pin sits, and is in intimate contact with, contribute energy which must also be carried up and back through the end-pin to become part of the energy radiated by the instrument itself, which in turn often adversely affects the tonality of the instrument. The end-pin of an instrument is thus more than just a prop to keep it off of the floor. It is also a two way conduit for energy; the stage floor and its resonant characteristics influence the sound of the instruments that by necessity of size and weight require use of an end-pin, such as but not limited to cellos, double basses, contrabassoons, and bass clarinets and other instruments that sometimes use an end-pin, such as bassoons and English horns. These instruments can have their tonality and playability improved by mechanically coupling a complimentary resonant body to the existing instrument. This complimentary resonant body will have to add resonant energy to those areas that are deficient in tonal strength while preserving the tonal balance of those areas already in balance.

A recent resonating device for the enhancement of an instrument's tonality is found in U.S. Pat. No. 5,920,020, where an air-chamber/enclosure large enough to provide seating for musician and instrument is excited by vibrations via the end-pin. In its background, the point is made that while some stage floors have sonic qualities that are musically relevant, most modern stage floors do not posses these qualities. Its design goal is to emulate the resonant qualities of a musical sounding stage floor. It resonates and enhances an instrument's lower registers, so as to achieve parity with the instrument's upper registers. It is a fixed-tonality device that for best effect should be matched to the particular instrument used with it. The size will restrict its use primarily for soloists because of space considerations, and unless carefully matched to its intended instrument, its inherent sonic bias in favor of lower tones could cause some dark sounding instruments to sound even further out of balance.

In U.S. Pat. No. 4,018,129 a resonating end-pin holder is designed to anchor and resonate sympathetically with the stringed instrument used with it, making the instrument louder. Its design emulates that of a stringed instrument with top and bottom resonating plates coupled together with a soundpost, with and without sides/air-chamber. It is also a fixed-tonality design whose construction was considered to be not as important as that of the instrument used with it. However, for it to be a truly complimentary resonant body, and thus more than just a volume control, it should be constructed and matched with the instrument used with it by a master craftsman, a time consuming and expensive process. When used with an instrument not matched with it, its fixed tonality could amplify and exacerbate tonal imbalances present in that particular instrument. As a major part of the design, compliant rubber feet are placed on the bottom plate to prevent slippage and to decouple the instrument from the floor. These feet will isolate and decouple the instrument from those stage floors which are musically resonant and thus can actually reduce the quality of sound that could be realized.

Traditional methods of making improvements to an instrument's tonality often require the replacement of parts and/or the disassembly or refinishing of the instrument. In the first case, owners of collectible instruments will usually not be eager to reduce the value of their instruments, especially since improved tonality cannot be guaranteed, and some parts like bows have become a realm of the collector where prices have become stratospheric. In the second, there is always a physical risk to the instrument involved when disassembly is required, and most traditional methods require steps that once taken, rarely if ever can be retraced to return the instrument to its previous sonics. In either case there is often an appreciable amount of time between the perception of the problem and its resolution. When disassembly is necessary, this period will often include months without the instrument.

For maximum effectiveness, a complementary resonant body will have to be either fabricated for one instrument only, and possibly for use during only one portion of the year as temperature and humidity changes will also change the tonality of that instrument, or its sonic attributes will have to be able to change along with the demands of the musical situation at hand. While resonant end-pin holders are known from the previous art, their tonalities are fixed at the point of construction. A field adjustable multi-mode tone-balancing end-pin holder with tonal characteristics that can be quickly adjusted by the musician and one that can be fine tuned for wide band and/or narrow band tonality problems in any part of that instrument's frequency range has no previous art. The need for a complementary resonant body with easily adjustable tonality is realized by the present invention

SUMMARY OF INVENTION

Accordingly, it is the object of the present invention to provide a multi-mode adjustable-tonality end-pin holder that avoids the disadvantages of the prior art.

More particularly, it is an object of the present invention to provide an easily portable multi-mode adjustable-tonality end-pin holder that can adapt to changing conditions, musical demands, and different instruments, quickly and easily even in the field. The present invention is sonically adaptable by acoustical-mechanical means to a degree previously restricted to the case of electronic audio equalizers, and can be configured to fully optimize the tonal qualities of an instrument. When a multi-mode adjustable-tonality end-pin holder is designed in accordance with the present invention, a musician will have a more balanced and thus a more beautiful tone that can be maintained under changing conditions which will help the musician to play all notes with less effort as well as to help correct those notes which were previously poor sounding and less dynamic, and additionally, a musician will have a means for matching the sound of the instrument to the type of music and size and tonality of the ensemble.

The vibrational energy from the instrument which is transmitted through the end-pin energizes the materials of the present invention whose individual resonances sum together and add to the energy of the instrument which is radiated by the present invention. In addition, some of the resonant energy of the present invention will also be conducted back up through the end-pin to be radiated by the instrument itself.

The acoustic signature of the present invention is determined by the shape and material of the base, the shape and material of the plurality of resonators that are fastened to the base, and the surface contours inscribed into the base. The signature is also determined by the tightness or looseness of the fasteners connecting the resonators to the base, the degree of tightness of the high-frequency-tonality-adjust fastener, and the placement of the end-pin in the retainer. In addition, the signature is also determined by the number, position and durometer hardness of the feet, and the optional use of the long retainer fastener to defeat the action of the decoupling feet in order to couple the instrument's vibrations to the stage floor in the case of a stage floor that has musically positive resonant qualities.

One feature of the present invention concerns the shape of the base. This triangular shape in conjunction with the anisotropic nature of wood reduces the partitioning of resonances normally found in rectangular shapes. The resulting distributed, wide band resonant contribution provides increased volume and projection of sound.

Another feature of the present invention is the end-pin restraint sub-assembly which is made up of a restraint and one or more gouge plates with appropriate fasteners. The restraint has a reasonable height to facilitate ease of use, and one or more center through-holes for acceptance of the end-pin. Multiple through-holes create multiple end-pin rest positions, where each position provides a different sonic character. The gouge plates having minimal height and no center through-hole except in the case of multiple end-pin rest positions. Multiple through-holes and multiple end-pin rest positions providing increased flexibility and quickness of tonal adjustments. Another tuneable aspect is provided by compliant washers between the retainer and the upper gouge plate. These washers provide energy storage and create a bass resonance. By adjusting the retainer's fasteners this resonance can be aligned for optimum tonal enhancement.

Still another feature of the present invention is the high-frequency resonance/tonality adjustment located at the narrow end of the base. The stress created by tightening the fastener raises the frequency of the resonant properties of the material and allows a musician to quickly adjust the area of high-frequency contribution, which is useful for tailoring the tonality of the present invention to the musical situation at hand.

Yet another feature of the present invention is the plurality of bar resonators which are fastened to the base and which act as narrow-band resonators. The length of these resonators varies so as to create wideband multi-mode tonal enhancement. Multiples of one type or length resonator can be used to increase positive effects, and shapes and surface contours can be varied to increase or decrease the tonal specificity of the resonator.

Another feature of the present invention is that the plurality of resonators can be individually compressed and dampened against the base by means of a plurality of threaded fasteners. Each resonator's sonic contribution can be lessened or increased by tightening or loosening its fastener, respectively, giving the musician another method of easily and quickly making tonal balance changes.

A significant feature of the present invention is the ability to use wood species other than "resonance woods" such as indented spruce and curly maple which are in ever increasingly short supply.

Other objects and advantages of the present invention will become apparent from the following descriptions, taken in connection with the accompanying drawings, wherein, by way of illustration and example, two embodiments of the present invention are disclosed.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
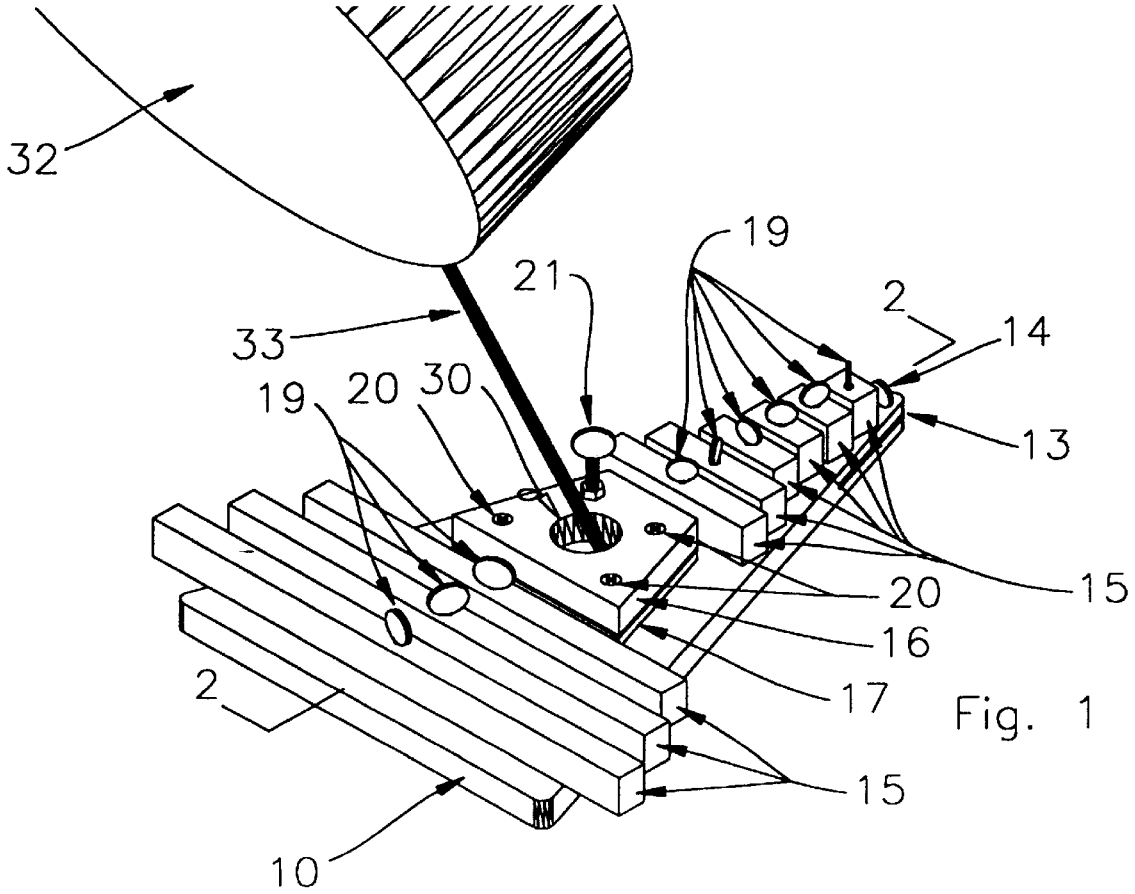
FIG. 1 is an isometric view of the multi-mode adjustable-tonality end-pin holder which embodies the principles of the present invention. For clarity, a single gouge plate is shown, and edge contours are not shown.

Referring now to FIG. 1 of the multi-mode adjustable-tonality end-pin holder of the present invention with tonality adjustable "in the field," a solid triangular base 10 is shown, a horizontal discontinuity 13, a high-frequency tonality adjustment fastener 14, a plurality of top mounted resonators 15 including an end-pin retainer 16 and gouge plates 17 and 18, a plurality of resonator fasteners 19, retainer fasteners 20, an extra long retainer fastener 21, a plurality of compliant feet 22, a plurality of compliant washers 23, a cello 32, and end-pin 33.

The base 10 is of a size to allow it to carry a sufficient number of resonators 15 for effective tonal supplementation and equalization while not being so large as to cause a musician to make multiple trips for set-up, or require more space than is normal in orchestral section settings. The base 10 of the preferred embodiments is a flat, solid wooden plate with nominal dimensions of sixteen inches in length, eleven inches in width, and three quarters of an inch in thickness, and of itself has specific resonant/tonal characteristics. Wood is a non-homogenous, anisotropic material, and sound travels easiest and with the highest velocity along the direction of the continuous internal structure of wood called the wood fibre. The triangular shape causes the lengths of the internal wood fiber structure to vary smoothly from a very short length to a much longer length. This internal structure of wood is in the form of cross-linked rectangular "tubes" imbedded in an amorphous lignin matrix, and cutting at an angle across the fibers causes a wide range of different length tubular pathways for longitudinal vibrations which in turn creates a wide band, sympathetic resonating system which emphasizes all of an instruments notes equally. This distributed resonance system also increases an instrument's volume and projection by increasing its radiating surface area. A similar sized rectangular base would have all "tubes" of the same length and resonant frequency, and would therefore form a narrow band resonator which would emphasize a much smaller group of notes, having specific resonance modes and harmonics. In practice, other non-triangular shapes or rectangular shapes with non-rectangular voids or discontinuities having a similar distribution of wood fiber lengths as a triangle, will also serve to distribute the resonant frequencies of the longitudinal vibrations in the desired manner. While common red oak is the material of choice of the preferred embodiment of the adjustable-tonality end-pin holder of the present invention, other species of wood will be acceptable, including other wood species not normally associated with orchestral instruments, depending on the tonal balance desired. While a nominal size for the base 10 seen in FIGS. 1 and 2 has been given, these dimensions are arbitrary and can be made larger or smaller as requirements change. It being understood that larger sizes soon become unwieldy and less than easily portable, and smaller sizes soon become too small to be effective except in very specialized cases.

Figure 2:
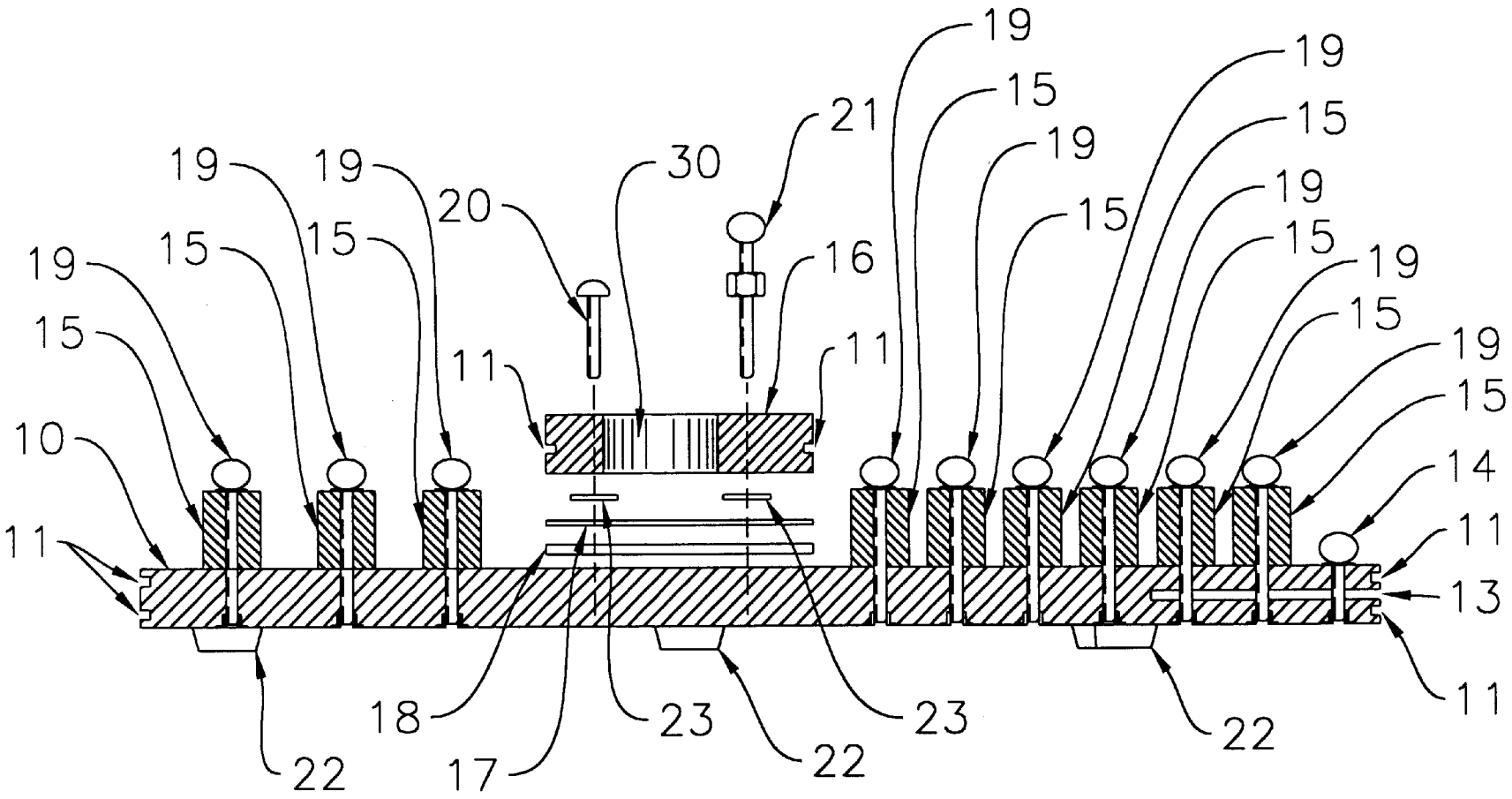
FIG. 2 is a side cross sectional view taken through the center of the multi-mode adjustable-tonality end-pin holder shown in FIG. 1.
Figure 3:
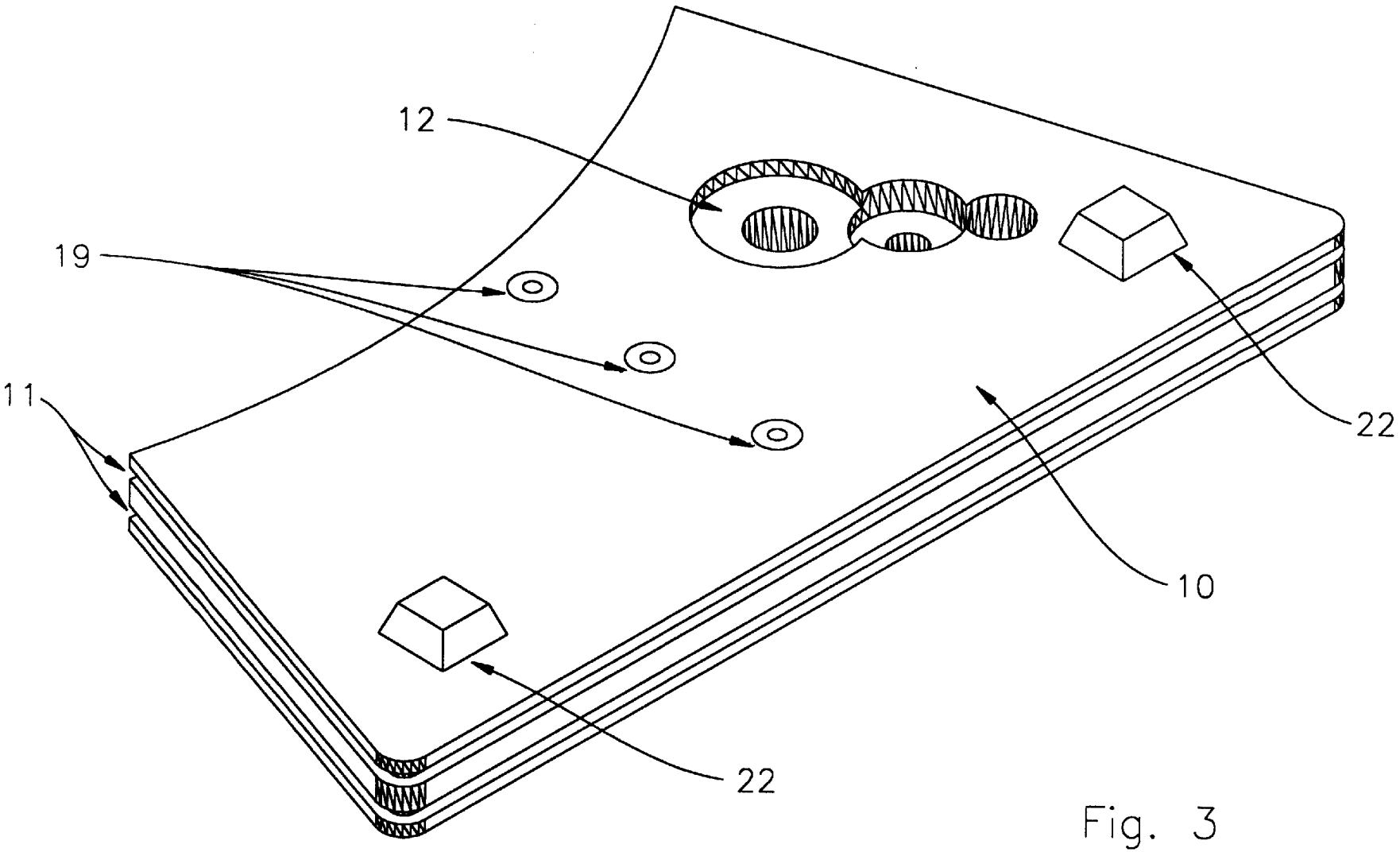
FIG. 3 is an underside isometric detail view of the surface contours.

The edge contours 11 seen in FIG. 2 create small cross sectional areas of wood with smaller dimensions which will have resonant properties of higher pitch than the main portion of the base 10. FIG. 3 of the present invention shows another type of contour, the surface contour 12 which in this case is a series of stepped counterbores which shorten some wood grain lengths, increasing the number of shorter wood grain lengths, and thereby the proportion of higher frequency longitudinal resonances in the base 10. By way of creating surface and edge contours, the tonality of resonant members such as the base 10 can be tailored to the desired effect, increasing the choices of appropriate wood for use in the present invention.

In accordance with an important feature of the present invention, there is shown in shown in FIGS. 1 and 2, a high-frequency resonance/tonality adjustment 14 formed by way of a horizontal discontinuity 13, which is created parallel to the top and bottom surfaces at the narrow end of the base 10. The two horizontal plates thus created deform, and each bends towards the middle when the fastener 14 placed close to the tip is tightened. The induced stress raises the frequency of the resonant properties of the deformed material, and increased tightening of the fastener 14 induces more stress which increases the pitch of the high frequency contribution of this stressed portion of the base 10. A musical saw has its pitch changed in the same fundamental fashion. This adjustment allows a musician to quickly adjust this contributor of high-frequency enhancement of the present invention, which is useful for tailoring the sound of the present invention to the music being played: some music will benefit from the higher material stress level from tightening the fastener 14 thus creating a note with more upper partials, while other music will benefit from the softer attack created by a looser setting of the fastener 14. Similarly, some instruments will benefit from a brighter tonal balance while others will not. This is a feature not found in other end-pin holders.

The plurality of discrete resonators 15, shown in FIGS. 1 and 2, act as a multi-mode narrow band bar resonator system. Their lengths are varied in such a way as to distribute the fundamental frequencies of the bars' transverse resonances so that they extend evenly through out the frequency range of the instruments used with the present invention. The species of the wooden resonators 15 are also varied so as to increase the possible tonal combinations. Because of the simple design of the resonators 15, selection of appropriate wood types for the present invention is much broader than when a wood type simultaneously has to resonate in a very specific manner, have shape restrictions, and fulfil structural functions as is the wood used for instance in cellos and basses. Types of wood that have been found to create useful resonators 15 of the present invention, include woods like Pernambuco and Ebony which are historically and currently being used in musical instrument construction, but also wood types that have not been sonically favorable such as Cocobolo, oak, Bloodwood, Zebrawood, and hickory. These and other woods can be very beautiful visually as well as sonically in the present application, and not only increase the aesthetics of the present invention but also allow use of wood types that are not in such critical short supply as are many of the specific woods used in string and woodwind instrument manufacture.

In practice, metals such as brass, copper, and aluminum, and other materials can also be used as resonators, but should be used sparingly because the majority component of an instrument's construction is wood and balance must be maintained when coupling resonant materials to an instrument.

Figure 4:
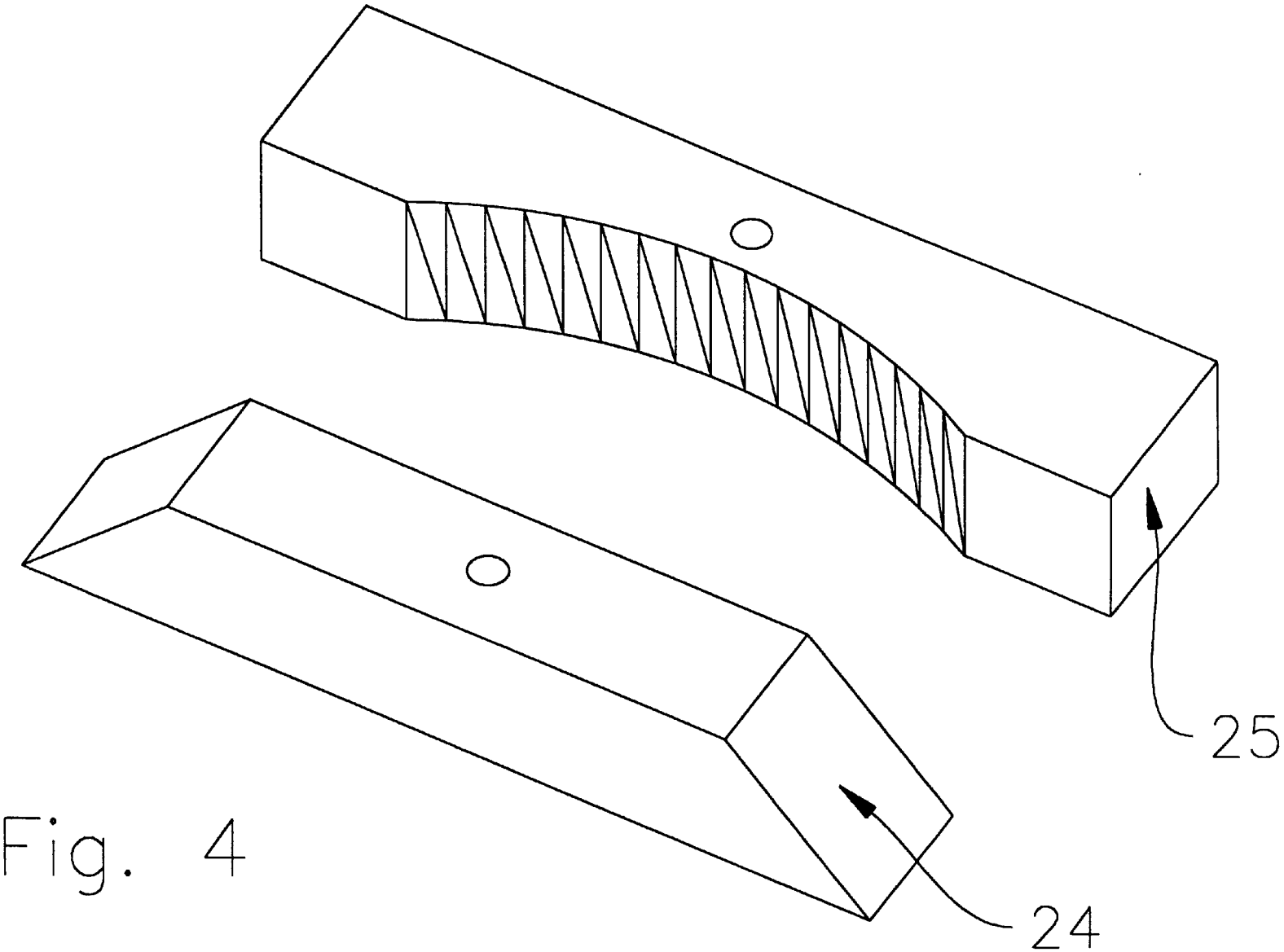
FIG. 4 is an isometric view of some alternative resonator shapes.

For optimum tonal compensation of an instrument, use of multiple resonators 15 of the same size or material, or use of resonators whose resonant specificity has been altered may be necessary. Examples seen in FIG. 4 include a wide band resonator 24 where the ends are beveled so as to create a diversity of wood fiber lengths and resonant frequencies, and a specially tuned resonator 25, where it has received marimba-key type contouring, in order to control its harmonics.

The exact sizes of the resonators 15, 24, and 25 seen in FIGS. 1, 2, 3, and 4 are not definable, in that wood is well known to be a material of varying characteristics and even same species wood from two different trees can vary enough sonically to make prediction a guessing game.

The plurality of resonator fasteners 19 shown in FIGS. 1 and 2, allow each resonator 15 to lie loosely against the base or to be individually compressed and dampened with varying degrees of force against the base 10 by means of threaded fasteners 19. These fasteners are to be understood to consist of a pair of male and female threaded entities, one of which will be fixed and the other moveable. Each resonator's tonal contribution can be lessened or increased by tightening or loosening its fastener 19, respectively; loosened resonators 15 being able to resonate freely, and tightened resonators 15 having been dampened against the surface of the base 10. As each resonator's tonal contribution is in a distinct and separate area of the spectrum, great flexibility is afforded to the musician on an as needed basis. There is no waiting period associated with making an improvement to the tonal balance of the instrument when it is used with the present invention. This adaptability of tonal balance also allows the present invention to be easily reconfigured with a different combination of tightened or loosened fasteners 19 for use with another instrument or style of music. The proper combination of fastened and loosened resonators 15 will be determined by repeated trials of playing the instrument with the present invention in place, and listening as the resonators dampening is varied. The resonators 15 are first listened to all fastened tightly to the base 10, and then one at a time listened to in a loosened state in order to hear where each resonator is affecting the tone of the instrument, and then tried in combination until a preferred combination is reached. When a higher level of tone balancing is required, the preceding steps are first taken, then one at a time, tightened resonators 15 are removed and clones of the loosened resonators 15 are substituted. The point of this part of the method is to strengthen those qualities already found desirable. When removing a tightened resonator 15 results in a lessor quality tonality, a same length resonator of a different species of wood or one having a different resonant character as in resonators 23 and 24 can be substituted. The point of this part of the method is to find the objectionable component of the resonant characteristics of the tightened resonator 15 and eliminate it.

This then, is an important benefit from having non-permanently fastened resonators 15 of the present invention in that as conditions or musical demands change, different resonators can be easily and quickly substituted. This can reduce the number of instruments needed for use with different styles of music, and thus can be very cost effective in terms of time, money, and effort expended in locating more than one suitable instrument. Conversely, this versatility will enhance the present invention's ability to enhance and optimize the tonality of more than one instrument.

The end-pin retainer 16 of FIGS. 1 and 2 provides the necessary function of restricting the movement of, and providing a placement guide for an end-pin 33. The retainer 16 is held in place with three standard fasteners 20 and one of extra length 21. The combination of the shape of the wooden end-pin retainer 16 which is trapezoidal, and the size of the through-opening 30 which accepts the end-pin 33, varies the lengths of the wood fibers creating another wide band resonator. Edge contours 11 shown in FIGS. 2 and 3, further diversify the resonant characteristics of the restraint 16 in the same way as the edge contours 11 of the base 10. Compliant washers 23 between the retainer 16 and the upper gouge plate 17 form an energy storage mechanism which changes frequency as the retainer fasteners 20 and 21 are tightened or loosened. This forms a resonance and tonal adjustment mechanism that operates in the bass frequencies which is variable and easily readjusted in the field to reinforce that area of the bass which will suit the needs of the musician and the instrument. When the stage floor is musically resonant in a supportive fashion, and the decoupling action of the compliant feet is tonally a disadvantage, the extra length retainer fastener 21 of the present invention can be extended to firmly contact the surface of the stage floor, mechanically coupling the adjustable-tonality end-pin holder of the present invention to the stage floor, resulting in improved sonics. Other end-pin holders lack this feature.

The trapezoidal gouge plates 17 and 18 are situated between the retainer 16 and the base 10. The primary function is to provide a renewable surface for wear and tear inflicted by the end-pin 33. The secondary effect is to create another resonant body. A thin plate of aluminum is the preferred material for the upper gouge plate 17 but softer materials that have been found acceptable include Pequia Amarello and Zebrawood. The lower gouge plate 18 is preferably red oak one quarter of an inch in thickness having a long dimension of five inches and the dimension at right angle a length of three and a half inches. The wood fiber orientation of the preferred embodiment of the present invention is parallel to that of the base 10 which is in the direction of its long axis. For optimum tonal balancing, the dimensions and wood fiber orientation can be varied to compliment the sound of the instrument or instruments used with the present invention.

The plurality of compliant feet 22 comprise the decoupling interface between the base 10 and the stage floor, attenuating higher frequency vibrations traveling in either direction, and also provide a high coefficient of friction between the base 10 and the stage floor, serving to anchor the instrument. The total compliance, or springiness, of this isolating interface formed by the plurality of compliant feet 22 is a function of the number and durometer hardness of the feet. The compliance of the feet together with the mass of the instrument form another energy storage mechanism, or resonance. This particular energy storage mechanism results in a bass resonance and the number, placement, and durometer hardness of the feet determine its musical relevance; reinforcement in some areas of the bass will enhance the sound of the instrument more than others. The position of the three pairs of compliant feet 22 along the long axis of the base 10 as shown in FIG. 2 have proven to be the preferred number and have the preferred position. As the mass of the instrument used with the adjustable-resonance end-pin holder of the present invention varies, in cases where a specific tonality emphasis is required, the exact number, type and composition of the elastomer, durometer hardness, and position of the compliant feet 22 will be determined by repeated trials of playing the instrument with the present invention in place, and listening to the results as the characteristics of the feet and their placement are varied.

Figure 5:
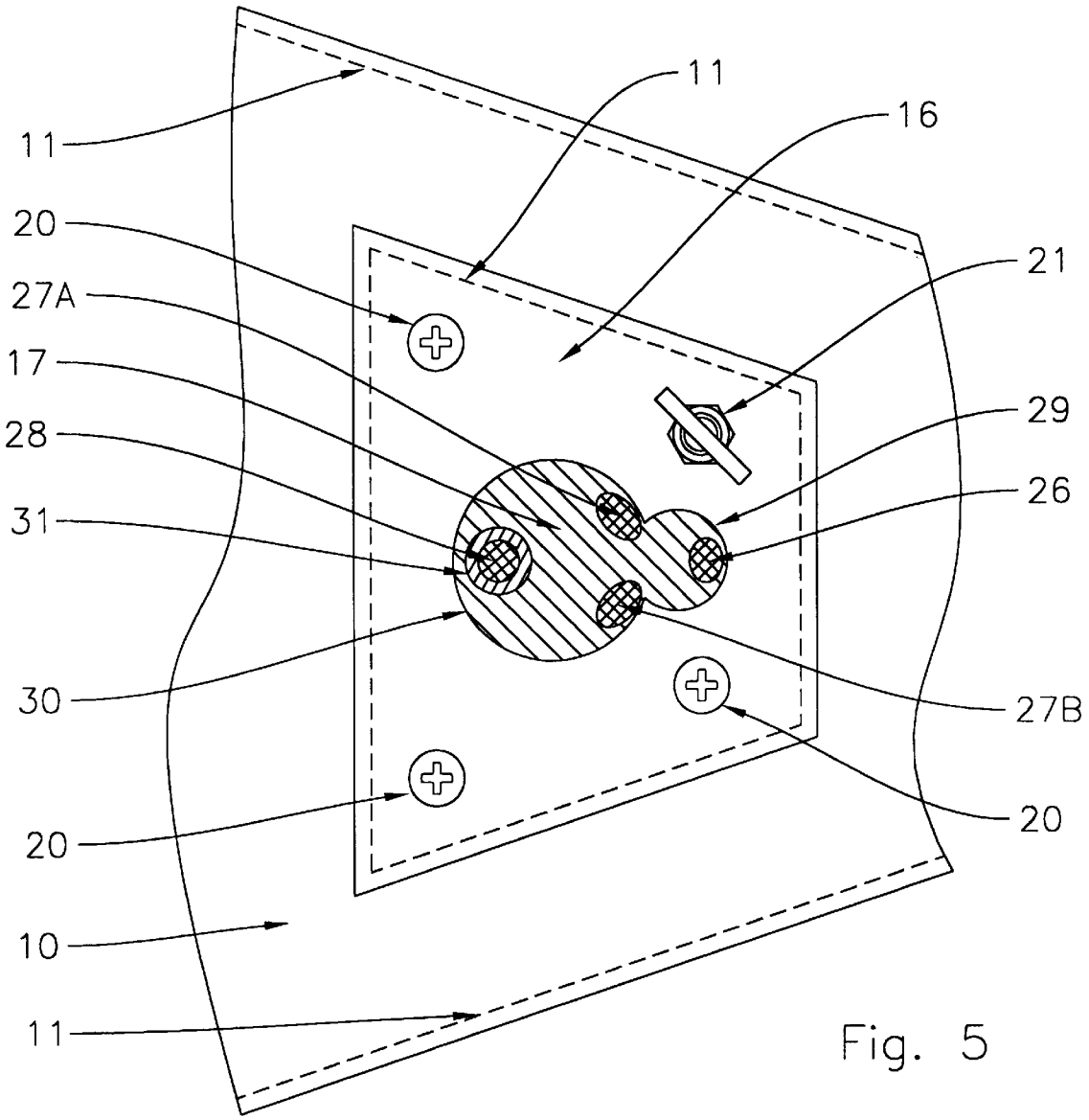
FIG. 5 is a plan view detail of a second embodiment of the retainer/gouge-plate portion of a holder in accordance with the invention showing multiple end-pin rest positions.

Referring now to FIG. 5 of the multi-mode adjustable-tonality end-pin holder of the present invention, an alternative embodiment is shown with a plurality of rest positions 26, 27A/27B, and 28, formed by adding a second through-opening 29 to the original through-opening 30 in retainer 16, and by adding through-opening 31 in gouge plate 17 and an indentation in gouge plate 18, which forms rest position 28.

In the embodiment shown in FIG. 5, provisions are made for quicker tonal changes than can be made by bending down and re-tensioning the fasteners 19 in order to change the resonant condition of the resonators 15. The retainer 16 has two overlapping through-openings 29 and 30 for insertion of the end-pin 33. The two openings create two different rest position areas 24 and 27A/27B on the upper gouge plate 17 where the end-pin 33 will naturally come to rest during a performance. The vibrations from the end-pin 33 enter the base 10 in one of these two areas 26 and 27A/27B, each area having its own characteristic driving point impedance and correspondingly each placement exciting a different group of flexural resonance modes in the base 10 when the end-pin 33 is placed in that rest position area of the present invention.

Two gouge plates are shown in FIGS. 2 and 5, where 17 is the upper plate and 18 is the lower plate. Referring now to FIG. 5, a through-opening 31 is placed in the upper gouge plate 17 of a size to provide clearance so that the end-pin 33 will not contact the material of the upper gouge plate 17 when the end-pin 34 occupies rest position 28, which is formed by a small indentation in the lower gouge plate 18 located under the through-opening 31 in the upper gouge plate 17. The upper gouge plate 17 is preferably aluminum or another bright sounding material, and the lower gouge plate 18 is preferably a soft sounding material such as the wood Padouk. When the end-pin 33 is placed in rest position 26 or 27, the vibrations from and to the instrument must pass through both gouge plate materials, and when the end-pin 33 is placed in rest position 28 the vibrations pass through only a single material. This results in a distinct tonal difference between energizing the present invention from end-pin 33 contact from anywhere on the upper gouge plate 17 including rest positions 26 and 27A/27B, from that which occurs when the end-pin 33 energizes the present invention from contact with the lower gouge plate 18 rest position 28. The mechanisms which cause the tonal differences include a driving point impedance change, and of equal importance, a difference in the absorption and transmission characteristics of the materials from which the gouge plates 17 and 18 are constructed. The crystalline structure of metal and the fibrous structure of wood have very different wave propagation parameters.

The advantage of the resulting dynamic and tonal contrasts from multiple end-pin rest positions lies in the quickness at which they can be changed during a performance. This is a technique and method unique to the present invention.

The tonal versatility of the present invention in the preferred embodiment shown in FIGS. 1 and 2 is sufficient to allow it to be manufactured as a single generic model suitable for improving the tonal balance and thus enhancing the tonal quality of different kinds of instruments with end-pins, with the added benefit of a lower cost than if each unit had to customized for use with only one instrument or one type of instrument. The same versatility will also allow the present invention, by way of customizing the selection of resonators with multiples of one shape, size, and/or wood type, to go beyond mere enhancement and allow the tonal balance of an instrument to be optimized for a specific sonic character, such as that found in instruments from a particular country and from a particular time period. This is also unique to the present invention.

Traditionally, major tonality changes to an instrument are accomplished with invasive procedures which often require disassembly of an instrument, or other techniques which once completed are irreversible. The ability to fine tune the appropriate amount of tonal compensation for the musical situation at hand, at home or in the field, and to make changes that if unsuccessful can be quickly reversed, is again unique to the present invention.

Without further explanation, the present invention is thought to be sufficiently well described and illustrated that persons skilled in the art to which the invention relates will be able to modify it and depart from the preferred embodiments for various applications without omitting features that, from the standpoint of the prior art, lie within the field and the spirit of this invention.

What is claimed:

1. A wide band multi-mode adjustable-tonality end-pin holder with field adjustable tonality for enhancing and optimizing the tonal balance and sonic quality of instruments with end-pins, utilizing a plurality of wood species including those not normally associated with orchestral instruments, comprising:

(a) a solid, flat, triangular base provided with compliant feet serving not only to anchor the instrument and decouple it from a stage floor, but also to create a musically relevant resonance, surface and edge contours for increasing the proportion of higher frequency resonances, and a horizontal discontinuity at one end of said base fitted with an adjustable threaded fastener for high-frequency tonality adjustment;

(b) a trapezoidal end-pin retainer with through-opening, edge contours, and adjustable threaded fasteners including one extra long fastener for converting the interface between said base and the stage floor from an interface that decouples and attenuates the transfer of vibrations to an interface that couples and promotes said vibrations, and one or more trapezoidal gouge plates, and compliant washers between said end-pin retainer and the upper gouge plate to create a variable bass resonance/tonality the frequency of which is adjustable with said fasteners;

(c) a plurality of bar resonators with varied lengths, shapes, and materials, and adjustable threaded fasteners that allow said resonators to resonate freely or be dampened against the base by tightening said fastener.

2. A holder as set forth in claim 1, wherein said base and end-pin retainer are wood, and said resonators and gouge plates are one or more of metal and the rest of wood.

3. A holder as set forth in claim 2, wherein said wood resonators and gouge plates are of a plurality of different wood species.

4. A holder as set forth in claim 3, wherein said end-pin retainer has multiple through-openings for the creation of a plurality of end-pin rest positions.

5. A holder as set forth in claim 4, wherein said gouge plates constitute a pair of plates and are of different materials sonically, and where said upper gouge plate has a through hole and said lower gouge plate has a depression located under the through-hole in said upper gouge plate for creating an additional and sonically different end-pin rest position where said end-pin does not contact said upper gouge plate but does contact said lower gouge plate.

6. A holder as set forth in claim 2, wherein said base has a non-triangular shape that has voids or wood fibre discontinuities that causes approximately the same distribution of short wood fibers to long wood fibers as in said triangular base.

7. A holder as set forth in claim 6, wherein said wood resonators and gouge plates are of different wood species.

8. A holder as set forth in claim 7, wherein said end-pin retainer has multiple through-openings for the creation of a plurality of end-pin rest positions.

9. A holder as set forth in claim 8, wherein said gouge plates constitute a pair of plates and are of different materials sonically, and where said upper gouge plate has a through hole and said lower gouge plate has an indentation located under the through-hole in said upper gouge plate for creating an additional and sonically different end-pin rest position where said end-pin does not contact said upper gouge plate but does contact said lower gouge plate.

10. A method of enhancing and optimizing the tonal qualities of instruments with end-pins that doesn't require invasive procedures to the instrument itself, by using a selectable combination of discrete resonators comprising the steps of:

placing the instrument's end-pin into the end-pin retainer of a resonant base structure having a plurality of resonators attached with adjustable fasteners, playing and listening to the instrument, and;

tightening or loosening said adjustable fasteners, playing and listening to the instrument again, repeating as necessary until the combination that provides the most appropriate tonal balance for the musical situation at hand is found.

11. A method as in claim 10, where multiple resonators of one shape, length, or material are used to enhance and optimize desirable tonal qualities.

12. A method of enhancing and optimizing the tonal qualities of instruments with end-pins by using selectable end-pin rest positions, comprising the steps of:

placing the instrument's end-pin into the end-pin retainer of a base structure having a plurality of end-pin rest positions, into one of the rest positions, playing and listening to the instrument, and;

moving the end-pin from position to position, playing and listening to the instrument again, to find the most appropriate tonal balance for the musical situation at hand.

13. A method of enhancing and optimizing the tonal qualities of instruments with end-pins that doesn't require invasive procedures to the instrument itself, by using adjustable compression fasteners and compliant materials to form one or more variable frequency resonators/energy-storage-mechanisms, comprising the steps of:

placing the instrument's end-pin into the end-pin retainer of a base structure having a plurality of variable resonators, playing and listening to the instrument, and;

tightening or loosening said fastener(s) associated with said variable frequency resonator(s), playing and listening to the instrument again, repeating as necessary until the most appropriate tonal balance for the musical situation at hand is found.

14. A method as in claim 13, where said compliant material is a natural or synthetic elastomer.

15. A method as in claim 13, where said compliant material is part of the structure of said base.

16. A method of enhancing and optimizing the tonal qualities of instruments with end-pins that doesn't require invasive procedures to the instrument itself, by changing the position and number of compliant feet used with an end-pin holder, comprising the steps of:

placing the instrument's end-pin into the end-pin retainer of a base structure having a plurality of compliant feet, playing and listening to the instrument, and;

changing the number and position of compliant feet, playing and listening to the instrument again, repeating as necessary until the number and position of compliant feet that provide the most appropriate tonal balance for the musical instrument is found.

17. A method as in claim 16, where the durometer hardness of said compliant feet is varied.

* * * * *